US009266007B2

(12) United States Patent
Vaughn

(10) Patent No.: US 9,266,007 B2
(45) Date of Patent: Feb. 23, 2016

(54) GOALIE SKATE

(71) Applicant: Michael A. Vaughn, Oxford, MI (US)

(72) Inventor: Michael A. Vaughn, Oxford, MI (US)

( * ) Notice: Subject to any disclaimer, the term of this patent is extended or adjusted under 35 U.S.C. 154(b) by 0 days.

(21) Appl. No.: 14/013,478

(22) Filed: Aug. 29, 2013

(65) Prior Publication Data

US 2014/0097583 A1 Apr. 10, 2014

Related U.S. Application Data

(60) Provisional application No. 61/710,192, filed on Oct. 5, 2012.

(51) Int. Cl.

| | |
|---|---|
| ***A63C 1/00*** | (2006.01) |
| ***A63C 1/42*** | (2006.01) |
| ***A63C 1/30*** | (2006.01) |
| *A43B 23/07* | (2006.01) |
| *A43B 1/00* | (2006.01) |
| *A43B 5/04* | (2006.01) |
| *A43B 5/16* | (2006.01) |
| *A63C 1/22* | (2006.01) |
| *A43B 7/20* | (2006.01) |
| *A43B 23/08* | (2006.01) |

(52) U.S. Cl.

CPC ..... *A63C 1/00* (2013.01); *A43B 5/1625* (2013.01); *A63C 1/303* (2013.01); *A63C 1/42* (2013.01); *A43B 1/0018* (2013.01); *A43B 5/04* (2013.01); *A43B 5/049* (2013.01); *A43B 5/16* (2013.01); *A43B 5/1616* (2013.01); *A43B 5/1666* (2013.01); *A43B 5/1683* (2013.01); *A43B 5/1691* (2013.01); *A43B 7/20* (2013.01); *A43B 23/07* (2013.01); *A43B 23/088* (2013.01); *A63C 1/22* (2013.01); *Y10T 29/49826* (2015.01)

(58) Field of Classification Search

CPC ..... A63C 1/00; A63C 1/42; A63C 1/22; A43B 5/1691; A43B 5/16; A43B 5/1625; A43B 7/20; A43B 5/04; A43B 5/1666; A43B 5/1683; A43B 1/0018; A43B 23/07; A43B 23/088; A43B 5/049; A43B 5/1616

See application file for complete search history.

(56) References Cited

U.S. PATENT DOCUMENTS

| | | | | |
|---|---|---|---|---|
| 5,845,421 | A * | 12/1998 | Tanaka | 36/117.3 |
| 6,431,604 | B1 * | 8/2002 | Goeckel | 280/811 |
| 6,550,159 | B1 * | 4/2003 | Madore | 36/115 |
| 2008/0238006 | A1 * | 10/2008 | Labonte | 280/11.12 |
| 2011/0169232 | A1 * | 7/2011 | Tatomir | 280/11.18 |

* cited by examiner

*Primary Examiner* — Brodie Follman
*Assistant Examiner* — Hilary L Johns
(74) *Attorney, Agent, or Firm* — Foster, Swift, Collins & Smith, P.C.; Zachary W. Behler

(57) ABSTRACT

The inventive skate consists of an upper that is designed to accept the foot of the user. Other portions of the upper are preferably constructed using a semi-rigid material, such as fiberglass, nylon, plastic, etc. These semi-rigid portions of the upper decrease the flexibility of the upper in certain sections, thus increasing performance. The inventive skate also includes a blade chassis. The chassis includes a lower portion that is adapted to hold the skate's blade and an upper portion that is adapted to cover a portion of the upper. The inventive skate is configured so that the center of gravity of the skater is disposed generally centrally along the length of the skate chassis. This skate configuration is generally referred to as neutral pitch.

15 Claims, 4 Drawing Sheets

GOALIE SKATE

CROSS REFERENCE TO RELATED APPLICATIONS

This application claims priority to U.S. provisional application Ser. No. 61/710,192, entitled "Goalie Skate," filed Oct. 5, 2012.

FIELD OF INVENTION

The present invention is in the field of a skate for ice or roller skating. More particularly, the present invention relates to a skate for use by a hockey goalie.

BACKGROUND OF THE INVENTION

In hockey, goalies do not typically skate for great distances during the course of a game. Instead, goalies typically stay stationary during a hockey game. Therefore, a goalie's skate typically has negative angle at the ankle area and then the blade is flat so the heel is not raised. This causes the goalie to lean forward into the laced area of the skate causing "lace bite." Further, goalies are often required to make certain athletic moves that are not typical for other hockey players. Therefore, there exists a need for a hockey skate specifically designed to accommodate athletic moves typically undertaken by goalies. The inventor has solved these problems by developing a unique hockey skate that accommodates athletic moves typically undertaken by goalies.

SUMMARY OF THE INVENTION

The inventive skate consists of an upper that is designed to accept the foot of the user. This upper is preferably partially constructed of soft materials, such as leather or canvas, in areas that contact the top side of the user's foot and ankle. These soft portions of the upper allow the skate to be adjusted to the particular shape of the user's foot using fasteners such as laces, buckles, straps, etc. Other portions of the upper are preferably constructed using a semi-rigid material, such as fiberglass, nylon, plastic, etc. These semi-rigid portions of the upper decrease the flexibility of the upper in certain sections, thus increasing performance. The semi-rigid portions of the upper provide increased protection for the user from injury due to contact by pucks, sticks, and other equipment. The upper is also fitted with a rigid sole plate that lies underneath the foot of the user when the skate is in use. This rigid sole is designed to increase the longitudinal rigidity of the skate and facilitate the connection between the upper and the blade chassis.

The inventive skate also includes a blade chassis. The chassis includes a lower portion that is adapted to hold the skate's blade and an upper portion that is adapted to cover a portion of the upper. The chassis is preferably constructed of a rigid material such as glass packed nylon. The inventive skate is configured so that the center of gravity of the skater is disposed generally centrally along the length of the skate chassis. This skate configuration is generally referred to as neutral pitch. The inventive skate is designed with a neutral pitch to accommodate the goalie's stance that is typically more upright than other hockey position players.

BRIEF DESCRIPTION OF DRAWINGS

Various other aspects and advantages of the invention will become apparent in connection with the accompanying drawings wherein.

DESCRIPTION

The following description is presented to enable any person skilled in the art to make and/or use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Figure 1:
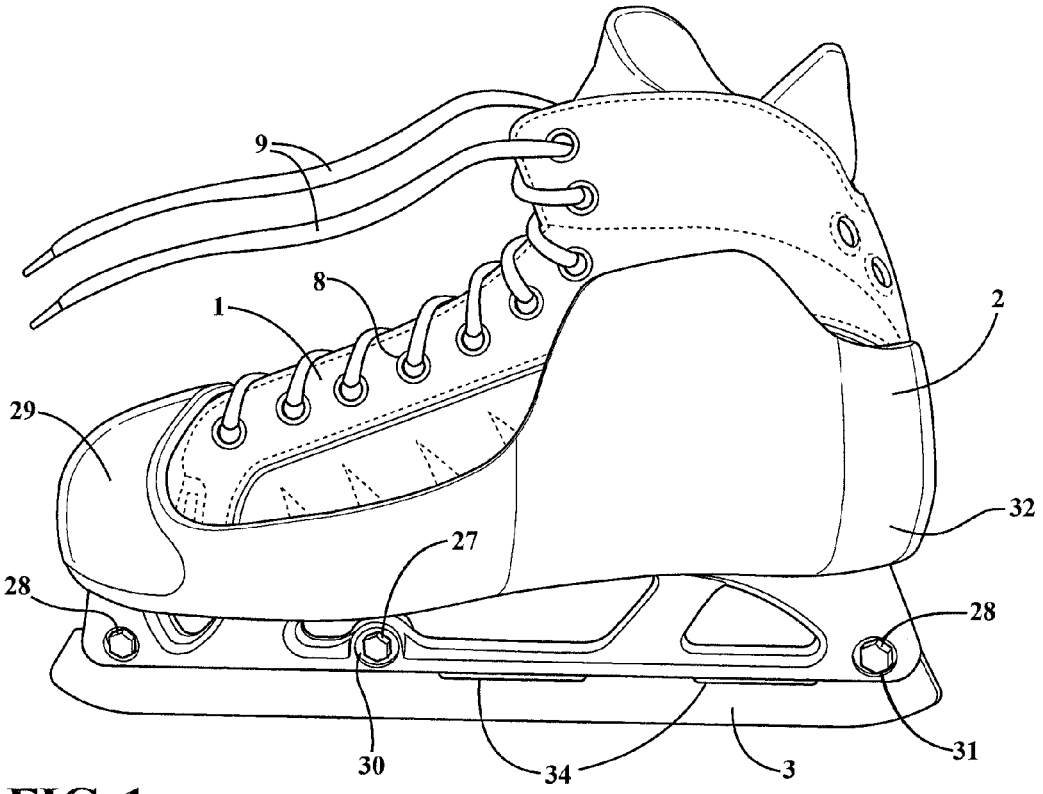
FIG. 1 is an instep view of the inventive skate.
Figure 2:
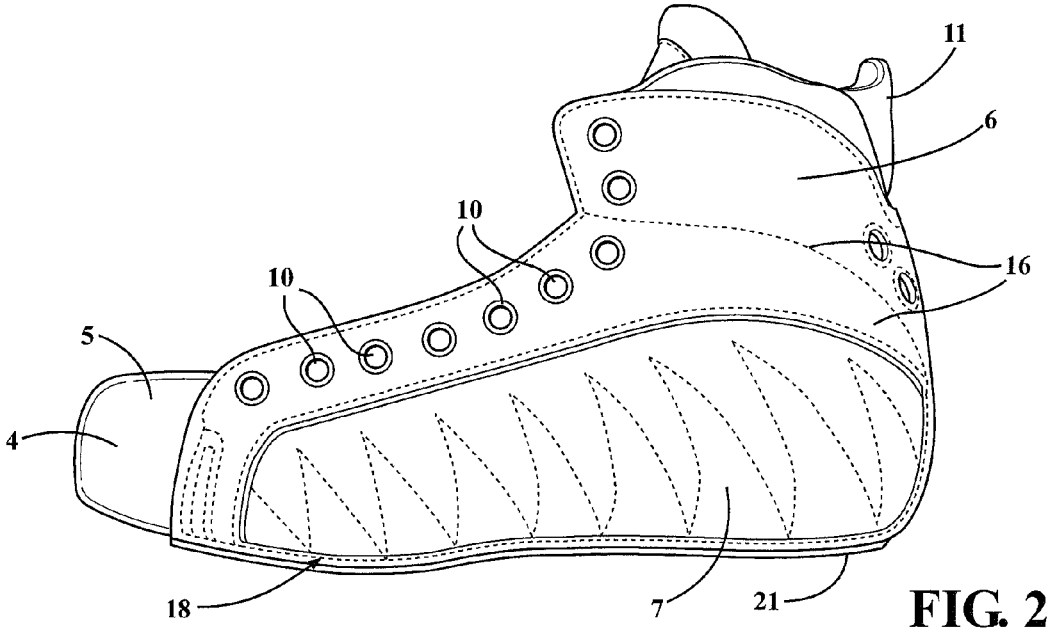
FIG. 2 is an instep view of the upper of the inventive skate.

FIG. 1 shows the instep of the assembled goalie skate. As depicted in FIG. 1, the Applicant's invention consists of an upper 1, a chassis 2, and a blade 3. FIG. 2 shows one component of the goalie skate assembly, the upper 1. The upper 1 can be made of any material suitable for constructing a skate. These materials may include canvass, leather, plastic felt, nylon, and synthetic materials. Ridged plastic pieces 4 may be used to prevent injury to the user in areas that are likely to be hit by a puck while the skate is in use. These areas may include the toe box 5 of the upper 1. Pliable materials such as canvass, leather, nylon, synthetics, etc. may be used to form the portions of the upper 1 that form to the user's foot such as the ankle 6 and mid-step portions 7.

The upper 1 may include a mechanism to form the upper to the user's foot 8, such as eyelets 10 and laces 9. However, any known tightening mechanism could be utilized such as buckles, straps, hook and loop fasteners, ratchets, etc. The mechanism to form the upper to the user's foot 8 may be located above the user's forefoot and in front of the user's ankle. However, the mechanism could be placed in other locations in the upper suitable for forming the upper to the user's foot.

The mechanism to form the upper to the user's foot 8 may also be used to help shape the ankle portion of the upper 6. The ankle portion of the upper 6 is angled forward from 90 degrees. This puts the foot in a more natural skating position reducing the need to lean into the laces 9. Such an embodiment increases circulation to the foot so that it does not become numb or cold. The mechanism to form the upper to the user's foot 8 may be fashioned into the upper 1 so that the goalie's ankle is positioned at a 65 degree to 90 degree angle to the user's foot. This may be accomplished by positioning the eyelets 10 for the laces 9 at an angel between 75 and 85 degrees from the foot.

Goalies are often required to extend their toe to provide increased coverage of the net while engaged in the game of hockey. To facilitate this movement a soft insert 11 may be placed at the top rear portion of the upper 1 to cushion the user's Achilles tendon should the user lean backwardly. Any material pliable enough to accommodate the extension of the goalie's toe such as cloth, rubber, spandex, nylon, neoprene, or other synthetic could be used to create this insert.

Figure 3:
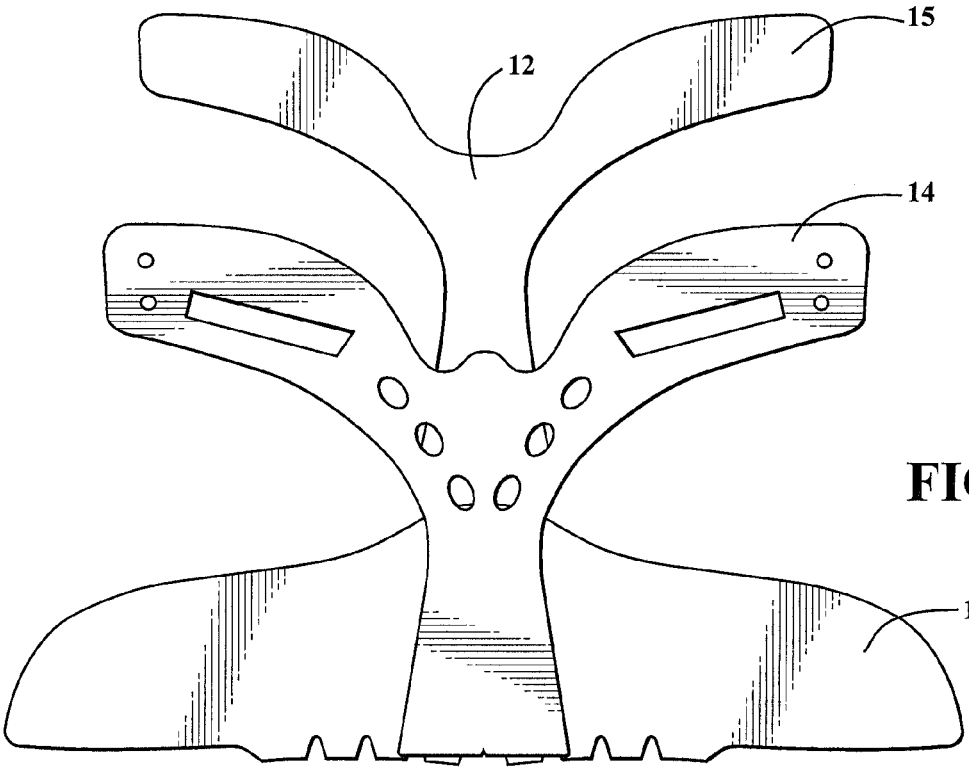
FIG. 3 is a view of the stiffening plates of the inventive skate.

A multiple piece stiffening plate 12 may be added to the ankle portion 6 of the upper 1. The stiffening plate 12 holds the user's foot down in to the skate for better control, and connects the instep and outstep of the skate together to provide support for the user's ankle. The stiffening plate 12 provides lateral strength in the upper 1 that allows the user to exert pressure on the skate blade, thus improving the performance of the skate. The stiffening plate 12 also increases the durability of the skate. FIG. 3 shows the stiffening plate 12 component of the skate assembly. The stiffening plate 12 can be constructed of any semi-ridged material, rigid material, or other material that is stretch resistant and suitable for use in skates. Varying the properties of the material serves to provide different levels of stiffness to the skate. The stiffening plate 12 may be constructed from a semi-rigid carbon fiber or aramid fiber. The stiffening plate 12 extends from the bottom of the user's heel and extends upwardly toward the user's ankle. The lower piece 13 of the plate 12 cups the user's heel and extends along the user's instep and outstep. A mid-piece 14 of the plate 12 extends underneath the inside and outside portions of the user's ankle. The upper piece 15 of the plate 12 extends to the inside and outside of the foot and extends over the top of the ankle bone location.

Figure 4:
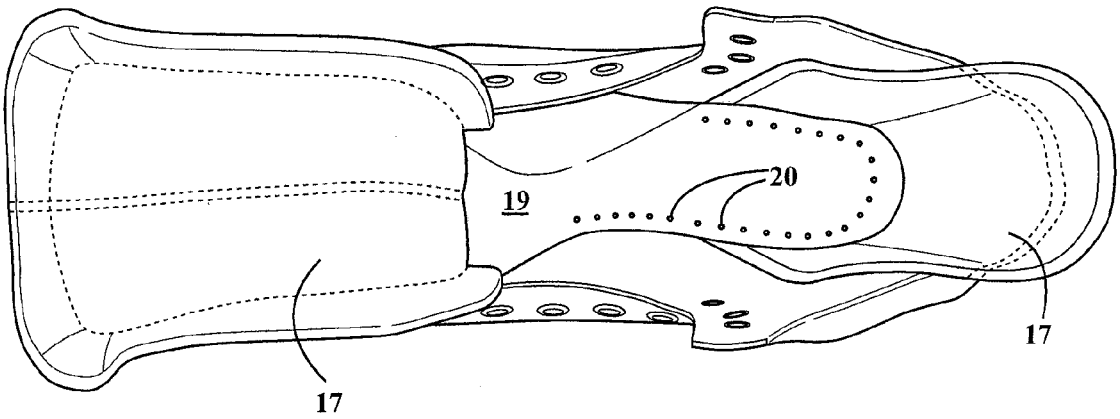
FIG. 4 is a top view of the top of the inventive skate.

Any means for attaching the upper 1 portion's constituent parts that is sufficiently durable to withstand the rigors of skating can be used to assemble the upper 1. The means for attaching the upper's constituent parts may be a combination of stitching 16 and adhesives. Other embodiments that do not require connection such as a single or multiple piece moldable thermo plastic exterior are also possible. FIG. 4 is a top view of the upper 1. As shown in FIG. 4, various types of padding 17 may be added to the interior of the upper to enhance the fit and comfort of the skate. Heat moldable foam padding may be added to the interior of the skate to allow users to customize the fit of the skate to their foot after purchase.

After the constituent parts of the upper 1 are assembled, the periphery of the upper 18 is attached to the upper sole 19. The upper sole 19 is generally shaped to lie underneath the user's foot when the skate is in use. The upper sole 19 can be fashioned from any material that facilitates its connection with the upper. The upper sole 19 may be constructed of fiber board. The periphery of the upper 18 is wrapped over the upper sole 19 and attached to the upper sole 19. This attachment may be accomplished by any means suitable for attaching the upper 1 to the upper sole 19 including stitching, adhesive, and mechanical attachment. This attachment may be done with staples 20.

Figure 5:
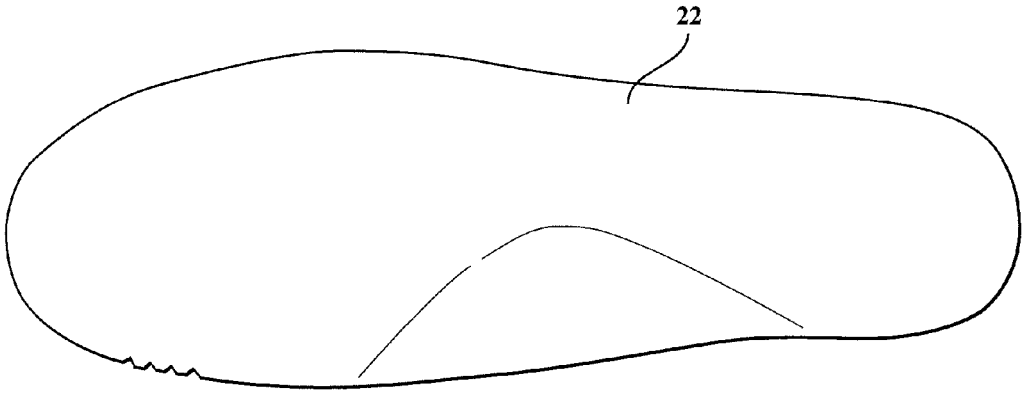
FIG. 5 is a top view insole of the inventive skate.

The upper 1 is then attached to a sole plate 21 constructed of a rigid material, such as plastic, metal, fiberglass, or carbon fiber. The sole plate 21 may be constructed from carbon fiber that provides an advantageous rigid support structure. The sole plate 21 is generally shaped in the same manner as the upper sole 19, to lie underneath the user's foot when the skate is in use. The sole plate 21 may be attached to the upper 1 using any form of attachment that is sufficient to maintain the integrity of the connection such as stitching, gluing, or mechanical attachment with hardware. The sole plate 21 may be connected to the upper using adhesives. An independent foot bed 22 may be placed into the upper 1 for added comfort. FIG. 5 depicts a foot bed 22 that may be placed in the upper. When a foot bed 22 is utilized, it is placed so that it lies between the upper sole 19 and the user's foot. Additionally, the foot bed 22 may conceal the connection between the upper sole 19 and the upper 1 making the inside of the skate more esthetically pleasing.

Figure 6:
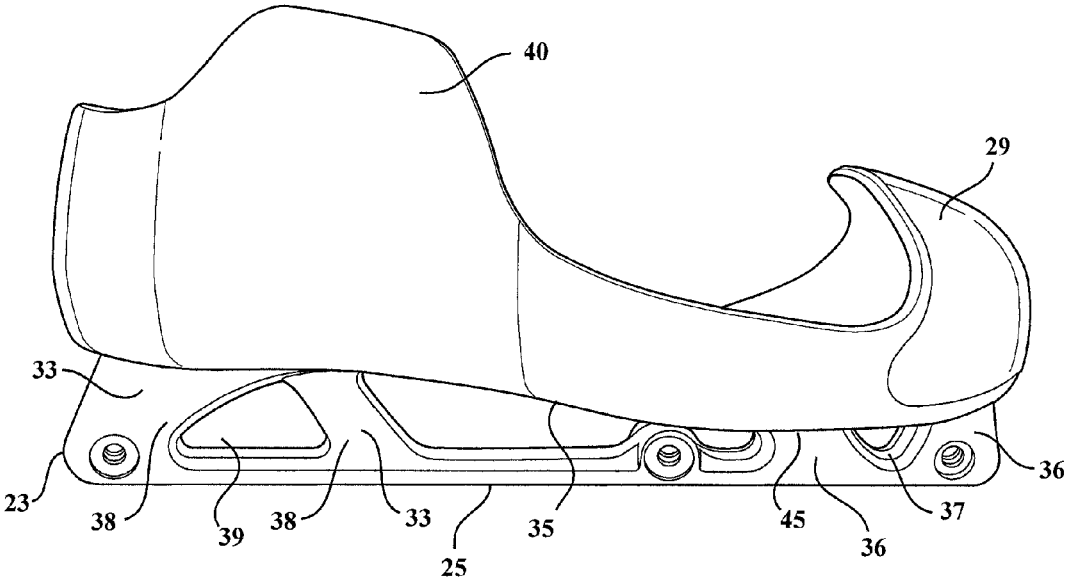
FIG. 6 is an instep view of the chassis of the inventive skate.

Referring now to FIG. 6, a chassis 2 is depicted. The chassis 2 is the portion of the skate located between the blade 3 and the upper 1. The chassis 2 can be made of any material that is strong enough to withstand the pressure that is exerted by the user upon the skate blade while the skate is in use. These materials may include, metal, plastic, glass packed nylon, synthetic materials, or a combination thereof.

The chassis 2 includes a lower portion 23 that is configured to attach to the top portion of the blade 24. This lower portion 23 may be configured with a channel 25 that is sized to receive the top portion of the blade 24. The top portion of the blade 24 may be secured in the channel 25 mechanically or with adhesives. The top portion of the blade 24 may be configured with tabs 26, some of which may receive bolts 28, 30 and 31 to attach the top portion of the blade 24 to the chassis 2. The position of the attachment bolts 28, 30 and 31 holding the top portion of the blade 24 into the chassis 2 is designed to make the blade 3 changeable so blades of different height, angle, thickness, or profile can be used. The blade 3 may be flat or rounded. If a rounded blade 3 is employed, the high spot can be located in different areas of the blade 3 to change the balance point for the user. A first bolt 28 may be positioned near the toe 29 of the skate. A second bolt 30 may be positioned under the ball of the foot. The location of the two front bolts 28 and 30 may be relatively close together to reduce twisting in the front of the blade when force is applied to the ice by the user. A third bolt 31 may be positioned under the heel portion 32 of the skate.

Figure 7:
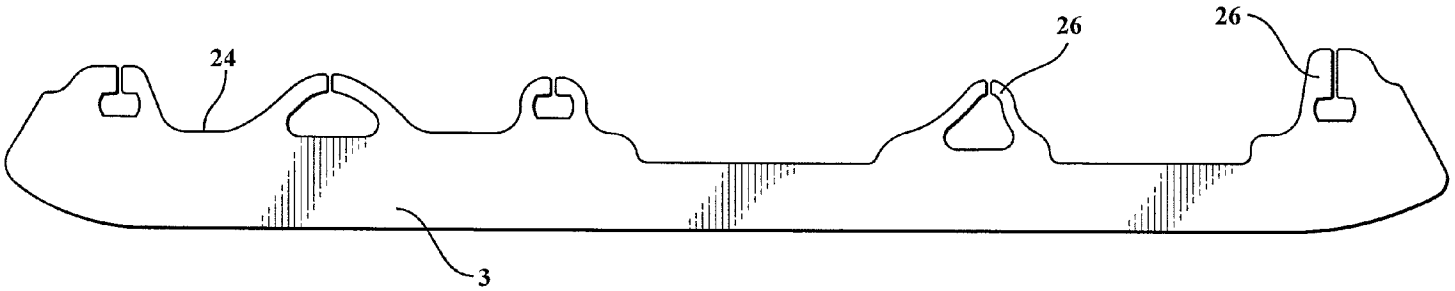
FIG. 7 is a side view of the blade of the inventive skate.
Figure 8:
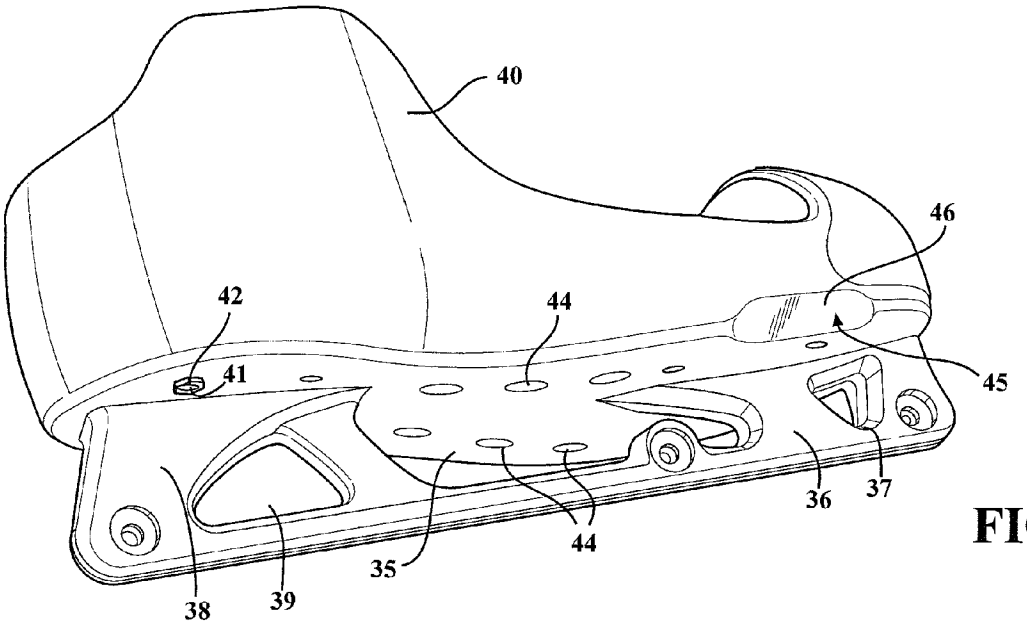
FIG. 8 is a perspective view of the chassis of the inventive skate.

Additional blade tabs 26 may extend into the front and rear support members 36 and 38 of the lower portion 23 of chassis 2 to increase the strength of the connection between the top portion of the blade 24 and lower portion 23 of chassis 2 and reduce twisting of the blade 3 while the skate is in use. Portions of the rear of the blade 34 that do not incur as much torque while in use may be reduced in height to reduce the weight of the skate and increase the skate's esthetic appeal. The blade 3 is designed with two areas 34 where the steel is cut away as depicted in FIGS. 1 and 7. The depth of these cut away areas 34 varies depending on the style of blade 3 utilized. For example, taller blades may accommodate larger cut away areas 34 that create a greater reduction in weight.

The lower portion 23 of chassis 2 may also be configured with a plurality of support members 36 and 38 that extend from the channel 25 to the sole platform 35. The sole platform 35 is configured to facilitate the connection of the chassis 2 and the sole plate 21. Near the toe 29 of the skate, the front support members 36 may be positioned to facilitate the attachment of laces from the goalie's foot pad to the chassis 2. To this end, the front support members 36 may be positioned to form a triangle pointing downwardly from toe 29 of the skate. The front triangular shaped opening 37 improves leg pad attachment to the toe 29 of the skate.

In the rear of the skate, the support members 38 may be positioned to facilitate the attachment of strapping from the goalie's leg pads to the chassis 2. To this end, the rear support members 38 may be positioned to form a triangle pointing upwardly towards the heel portion 32 of the skate. This rear triangular shaped opening 39 allows the strap on the rear of the goalie's leg pad to make full surface contact with the rear support members 38 and enhances the connection between the goalie's leg pad and the skate.

The upper portions of the chassis 2 comprise the sole platform 35 and the cowling 40. The cowling 40 is the upper portion of the chassis 2 that extends above the sole plate 21 of the upper 1. The attachment between the sole plate 21 of the upper 1 and the sole platform 35 of the chassis 2 may be made by any method sufficient to ensure the integrity of the attachment while the skate is in use such as bolts, screws, rivets, stitching, adhesive, etc. In one embodiment, bolts 41 are inserted through holes 42 in the sole platform 35 and the sole plate 21 and are connected to flat nuts 43 placed under the foot bed 22 in the interior of the upper 1. The sole platform 35 may be constructed in various shapes that accommodate the support of the upper 1. Auxiliary features, such as drainage holes 44, may be added to the sole platform 35, or other parts of the chassis 2 to enhance both the look and function of the skate.

The cowling 40 can take various shapes, but is generally configured to protect the portions of the goalie's foot and ankle that are most likely to be struck by the puck or other objects. These include the interior portions of the ankle and the goalie's instep because these areas become exposed when the goalie stretches out his/her leg to deflect a shot. The cowling 40 may also extend over the toe 29 and heel 32 portions of the skate. In the forward instep portion of the cowling 40, a rest platform 45 may be added. This portion of the cowling 40 covers the inner portion of the user's big toe and is the area that first contacts the ice when the goaltender is leaning inward. This rest platform 45 eliminates the sharply angled connection between the sole platform 35 and the cowling 40 in this portion of the chassis 2 by cutting a bevel 46 into the junction of the sole platform 35 and the cowling 40. The bevel 46 of the rest platform 45 may be cut at a 45 degree angle although other acute angles could be used. This allows the goaltender to get much lower to the ice and achieve a steeper skate angle while maintaining blade 3 contact with the ice. This enhances the goalie's ability to push and move laterally for added performance. The rest platform 45 also creates a surface to where the goaltender can easily balance and hold position using less body strength.

The invention claimed is:

1. A skate comprising:

an upper configured to position the foot of the user so that the user's ankle is leaned forward;

an upper sole connected to a periphery of the upper;

a sole plate connected to the upper sole;

a blade;

a chassis with a lower portion connected to the blade and an upper portion that comprises a sole platform to connect to the sole plate of the upper and a cowling configured to extend above the sole plate of the upper and protect portions of the user's foot;

an attachment means for connecting the sole platform of the chassis to the sole plate; and an attachment means for connecting the chassis to the blade.

2. The skate of claim 1, wherein the upper is configured to position the ankle of the user at a 65 degree to 90 degree angle to the user's foot.

3. The skate of claim 2, wherein the attaching means for connecting the chassis to the upper includes fasteners permanently connect the sole platform of the chassis to the sole plate.

4. The skate of claim 1, wherein the upper further comprises a stiffening plate located in the ankle portion that extends from the upper sole above the user's ankle.

5. The skate of claim 4, wherein a soft insert is placed at the top rear portion of the upper above the user's ankle to cushion the user's Achilles tendon in the event the user leans backwardly against the stiffening plate.

6. The skate of claim 4, wherein a stiffening plate is located in the ankle portion of the upper comprising:

a lower piece configured to cup the user's heel;

a mid piece configured to extend underneath the inside and outside portion of the user's ankle; and an upper piece that extends over the top of the user's ankle bone.

7. The skate of claim 1, wherein the forward instep portion of the upper portion of the chassis includes a rest platform.

8. The skate of claim 1, wherein the lower portion of the chassis comprises:

a channel that is sized to receive tabs located on the top portion of the blade; and three attachment bolts that attach the top portion of the blade to chassis.

9. The skate of claim 8, wherein a first bolt is positioned near the toe of the skate, a second bolt is positioned under the ball of the foot, and a third bolt is positioned under the heel portion of the skate.

10. The skate of claim 8, wherein the lower portion of the chassis contains a plurality of front and rear support members that extend from the channel to the sole platform and are positioned to facilitate the attachment of laces from the goalie's foot pad.

11. The skate of claim 10, wherein the front support members are positioned so that the gap between them forms a triangle pointing downwardly from the toe of the skate.

12. The skate of claim 10, wherein the rear support members are positioned to facilitate the attachment of strapping from the goalie's leg pads to the chassis.

13. The skate of claim 12, wherein the rear support members are positioned so that the gap between them forms a triangle pointing upwardly to the heel of the skate.

14. The skate of claim 1, wherein the sole plate is constructed of carbon fiber.

15. The skate of claim 1, wherein the upper sole is connected to a periphery of the upper with staples.

* * * * *